US009388573B2

(12) United States Patent
Claessens

(10) Patent No.: US 9,388,573 B2
(45) Date of Patent: Jul. 12, 2016

(54) STEEL LATTICE CONFIGURATION

(71) Applicant: Sismo Trading Ltd., Naxxar (MT)

(72) Inventor: Olaf Claessens, Kalken-Laarne (BE)

(73) Assignee: Sismo Trading Ltd., Naxxar (MT)

( * ) Notice: Subject to any disclaimer, the term of this patent is extended or adjusted under 35 U.S.C. 154(b) by 0 days.

(21) Appl. No.: 14/388,216

(22) PCT Filed: Mar. 28, 2013

(86) PCT No.: PCT/EP2013/056744
§ 371 (c)(1),
(2) Date: Sep. 25, 2014

(87) PCT Pub. No.: WO2013/144309
PCT Pub. Date: Oct. 3, 2013

(65) Prior Publication Data

US 2015/0033654 A1 Feb. 5, 2015

(30) Foreign Application Priority Data

Mar. 28, 2012 (EP) ..... 12161845

(51) Int. Cl.
*E04B 9/00* (2006.01)
*E04F 13/04* (2006.01)
*E04B 2/84* (2006.01)

(52) U.S. Cl.
CPC . *E04B 2/845* (2013.01); *E04B 2/84* (2013.01); *E04B 2/847* (2013.01); *Y10T 428/12347* (2015.01)

(58) Field of Classification Search
CPC ..... E04B 2/845; E04B 2/84; E04B 2/847; E04B 2/8617; E04B 2/8658; E04B 2/8635; E04C 2/288; E04C 2/044; E04C 5/064; Y10T 428/12347
See application file for complete search history.

(56) References Cited

U.S. PATENT DOCUMENTS

| | | | | |
|---|---|---|---|---|
| 4,104,842 | A * | 8/1978 | Rockstead et al. | 52/649.1 |
| 4,731,971 | A * | 3/1988 | Terkl | 52/742.14 |
| 4,864,792 | A * | 9/1989 | Andre et al. | 52/426 |
| 5,771,648 | A * | 6/1998 | Miller et al. | 52/309.7 |
| 6,691,486 | B1 * | 2/2004 | Durand | 52/645 |
| 2004/0134158 | A1 * | 7/2004 | Farrell et al. | 52/664 |
| 2005/0086900 | A1 * | 4/2005 | Reynolds | 52/745.19 |

FOREIGN PATENT DOCUMENTS

| | | |
|---|---|---|
| EP | 0 061 100 | 9/1982 |
| EP | 1 447 488 | 8/2004 |
| WO | WO 92/18718 | 10/1992 |

* cited by examiner

*Primary Examiner* — Brian Mattei
(74) *Attorney, Agent, or Firm* — Levy & Grandinetti

(57) ABSTRACT

A prefabricated wall module is disclosed. The wall module includes a series or plurality of lattices. The series of lattices includes (a) defining at least one slot accommodating a panel, and (b) defining a grid along an outer surface of the wall module wherein at least one end-standing lattice of the wall module is structurally different from one or more of the other lattices in the wall module.

6 Claims, 6 Drawing Sheets

STEEL LATTICE CONFIGURATION

This Application is the U.S. National Phase of International Application Number PCT/EP2013/056744 filed on Mar. 28, 2013, which claims priority to European Patent Application Number 12161845.8 filed on Mar. 28, 2012.

FIELD OF THE INVENTION

The present invention relates to a prefabricated building module used in the construction industry.

BACKGROUND OF THE INVENTION

In the modern construction industry, the concept of prefabricated wall modules is widely used. Prefabricated wall modules make it easier to raise buildings due to the minimum of work needed at the construction site, moreover fabricating wall modules in a controlled environment allows more precise and more efficient construction.

Equally in view of more efficient construction, it has been a trend to add grids to wall modules for accommodating stucco or plaster as disclosed in EP0061100. It has now been observed when applying stucco, plaster or concrete on such wall modules comprising a grid, cracks tend to appear after a period of time. These cracks are aesthetically unacceptable and require further handling of the coating of the wall before applying a layer of paint.

Given the above, there remains a need for improving the prefabricated wall module to overcome the above inconveniences.

SUMMARY OF THE INVENTION

The present invention addresses the above inconveniences and causes.

1) A prefabricated wall module comprising a plurality of lattices, said series of lattices:

a) Defining at least one slot accommodating a panel b) Defining a grid along an outer surface of said wall module Characterised in that at least one end-standing lattice of said wall module is structurally different than one or more of the other lattices in the wall module. Surprisingly such wall does improve the quality of the stucco, plaster or concrete applied thereon.

DESCRIPTION OF THE INVENTION

In a preferred embodiment of the present invention a prefabricated wall module comprises both end-standing lattices and intermediate lattices. Wherein said end-standing lattices of said wall module do not form part of said grid.

According to the preferred embodiment of the present invention said grid comprises brace-wires connecting said series of lattices and wherein said brace-wires are bent towards the panel in proximity of at least one edge of said wall module. A coating is applied on at least part of said grid in proximity of the wall module edges. The said coating being plaster, concrete or a construction adhesive.

In addition a wafer having incisions corresponding to the grid structure is provided on the wall module, the grid being accommodated in the incisions such that the wafer is retained on the wall module.

DETAILED DESCRIPTION OF THE INVENTION

Figure 1:
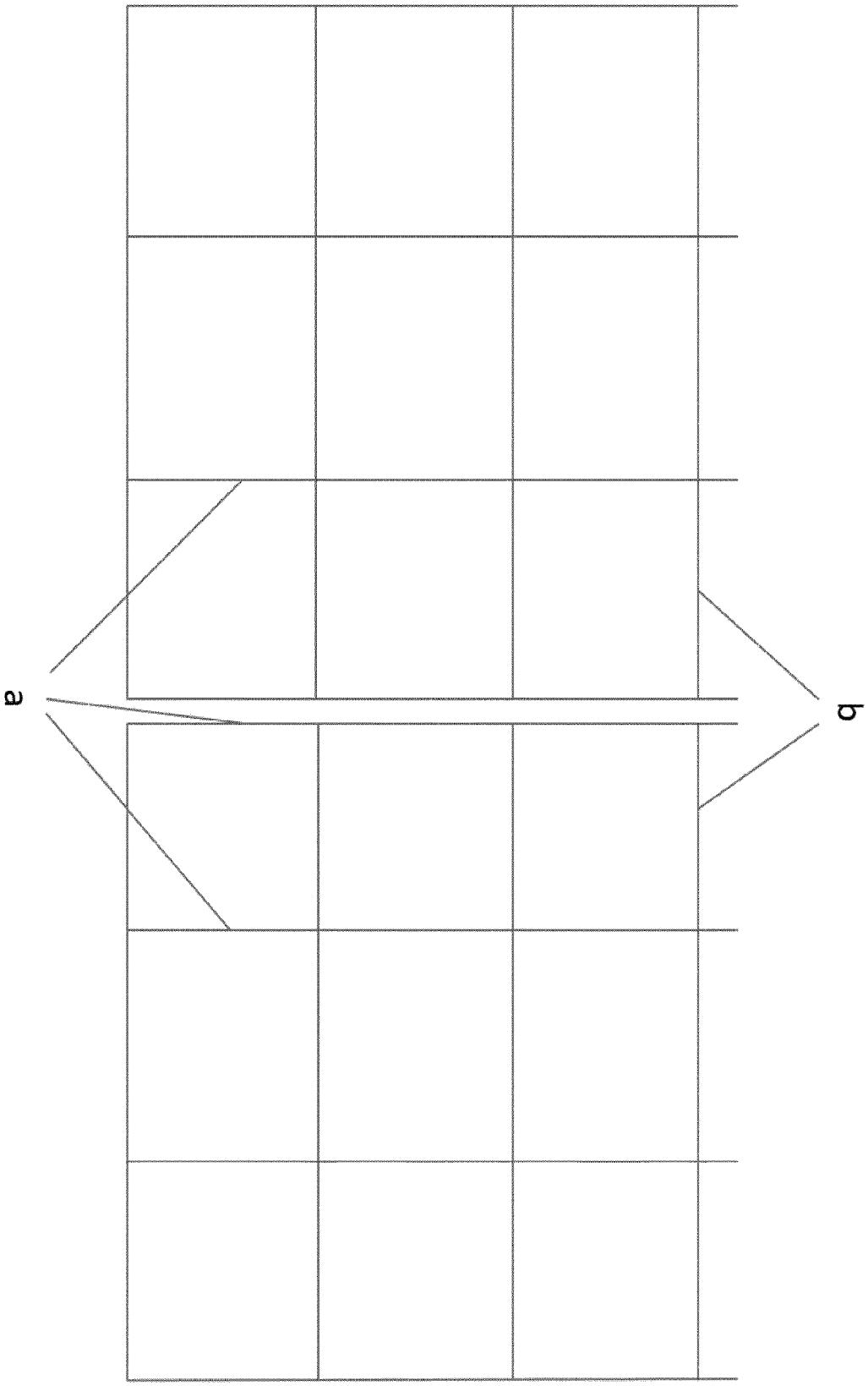
FIG. 1 represents a side view of two wall modules according to the present invention

FIG. 1 represents a side view of a wall comprising two prefabricated wall modules according to the present invention. Said wall modules comprise a three-dimensional framework with (a) a series of lattices placed one in front of the other, perpendicular to the wall surfaces and (b) a plurality of brace wires extending in a lengthwise direction of the wall module and connecting the series of lattices.

Said three-dimensional framework comprising a grid extending along the surface of the prefabricated wall module for accommodating a covering material such as stucco, plaster, concrete or construction adhesives such as epoxy, silicones and common (polymer) adhesive pastes (e.g. Knauff), which grid is defined by outer wires of the series of lattices and by said brace wires.

According to the present invention, the wall module comprises at least two types of lattices that are structurally different one from another, whereby a first type of lattice comprises an outer wire making part of said grid and second type of lattice that does not comprise an outer wire making part of the grid.

Figure 2:
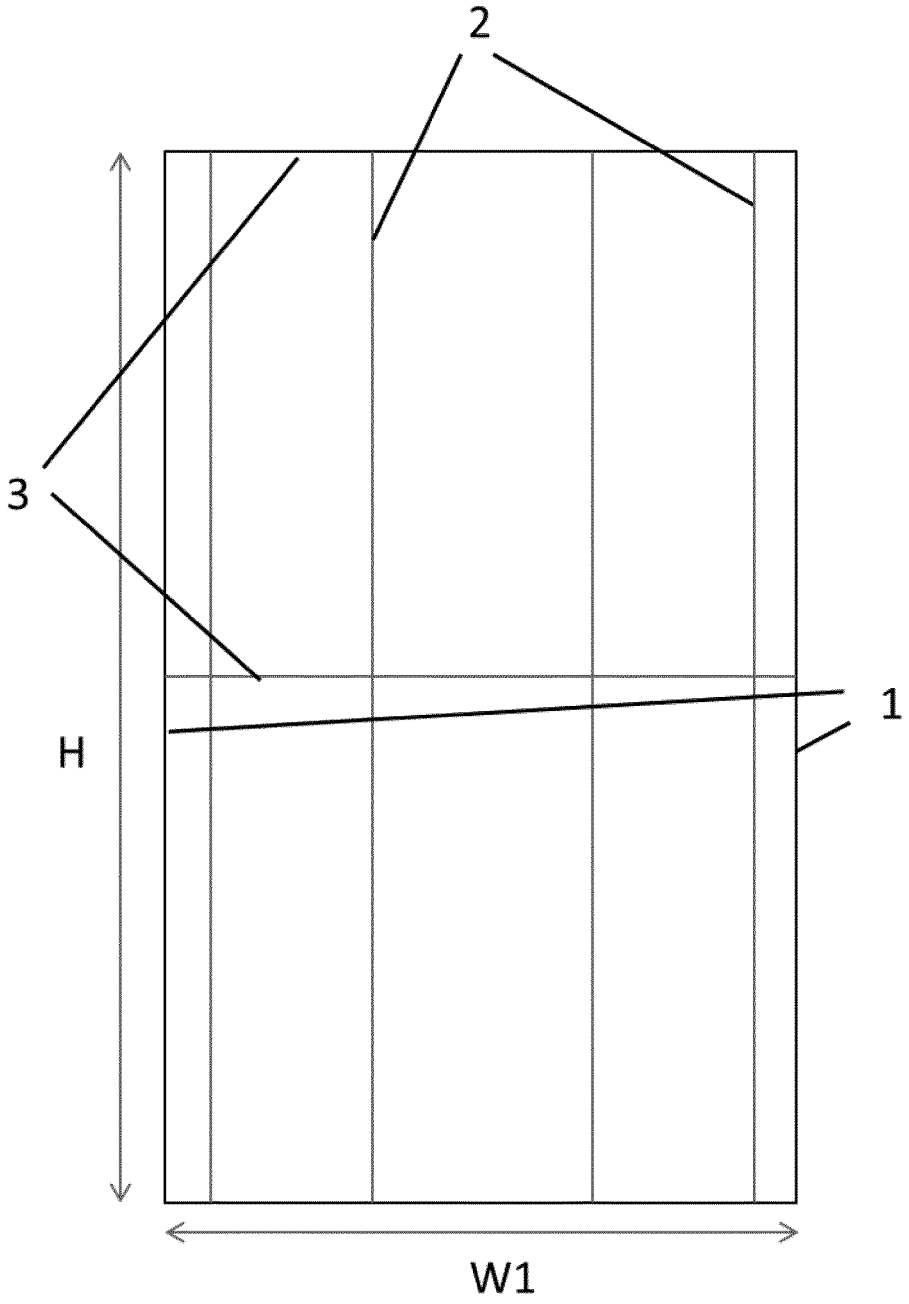
FIG. 2: Frontal view of the intermediate lattice

In the current embodiment, the first type of lattice as represented in FIG. 2 comprises six longitudinal wires—two outer wires 1 and four intermediate wires 2—extending parallel to the surface of the wall module and a number of transverse wires 3 extending perpendicular to said surface and welded on said longitudinal wires.

Figure 3:
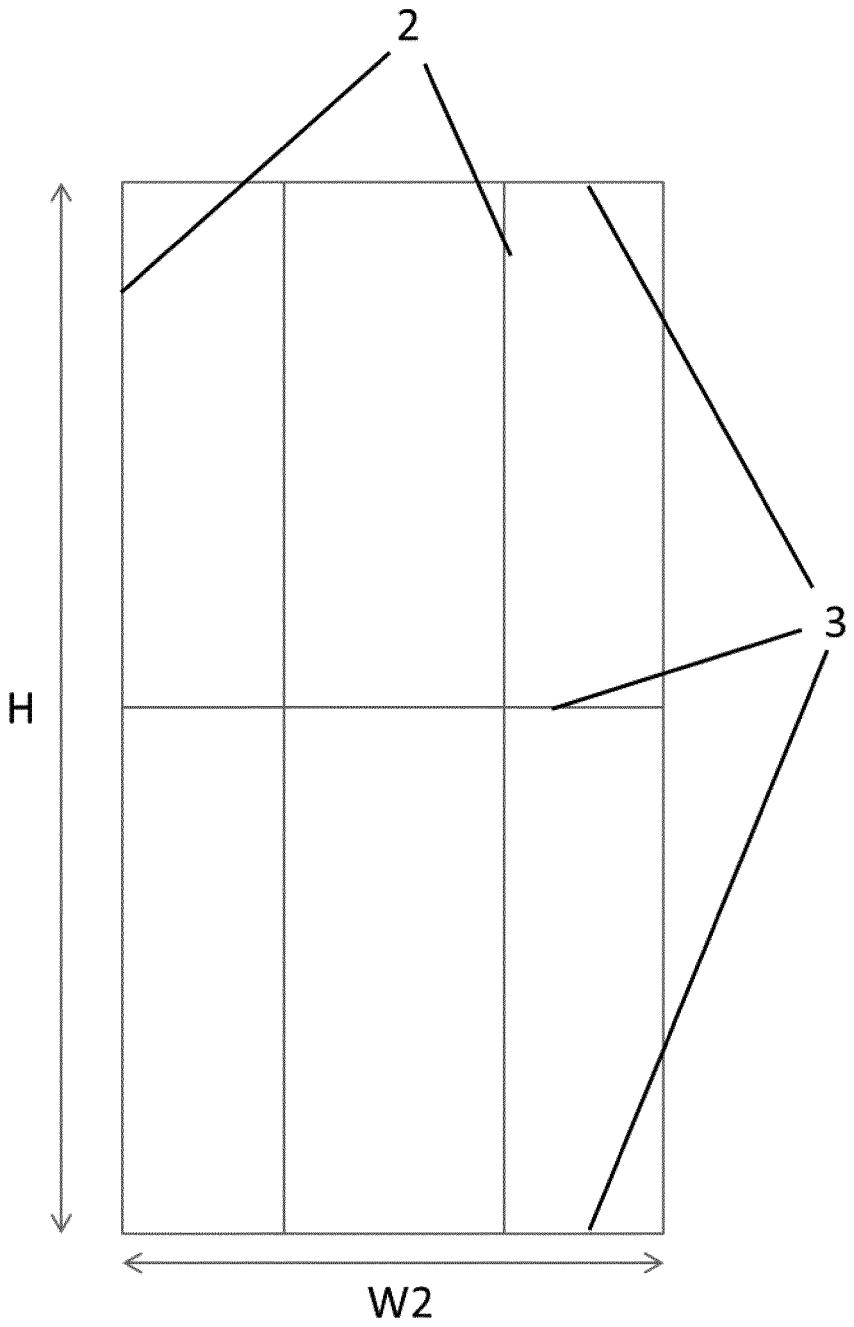
FIG. 3: Frontal view of the outer lattice

The second type of lattice as represented in FIG. 3 comprises only four parallel wires corresponding to the intermediate wires of the first type of lattice and a number of transverse wires 3 preferably corresponding to the transverse wires in the first type of lattice and welded to said longitudinal wires.

The lattice wires are preferably made out of galvanized metal and typically have a diameter of 2.2 mm. The longitudinal wires typically have a length H ranging between 2.60-3.50 m (corresponding to the height of a building floor), whereas the transversal of the first type of lattices typically have a length W1 ranging between 0.10 and 0.30 m. The second type of lattice typically has a thickness W2 (transverse wire direction) of 0.01 to 0.02 m less than the first type of lattice. It is obvious that these values are purely illustrative and may vary according to the particular requirements of the construction.

The intermediate longitudinal wires of the first type and the longitudinal wires of the second type of lattices define together with the transverse wires of the three dimensional framework one or more and in the represented embodiment, two slots for accommodating panels defining a cavity in between them for receiving a load bearing material such as concrete.

The panels are preferably light-weight panels made in an insulating material such as polyurethane foam, polystyrene, mineral wool, cork or cardboard. Clearly according to the need, other materials can be used for manufacturing said panels such as concrete; hard board (OSB, MDF); fibrous materials such as fiberglass; or of laminated materials, or mixtures of materials. In short, in specific case the material may even be non-insulating or non-metallic.

Figure 4:
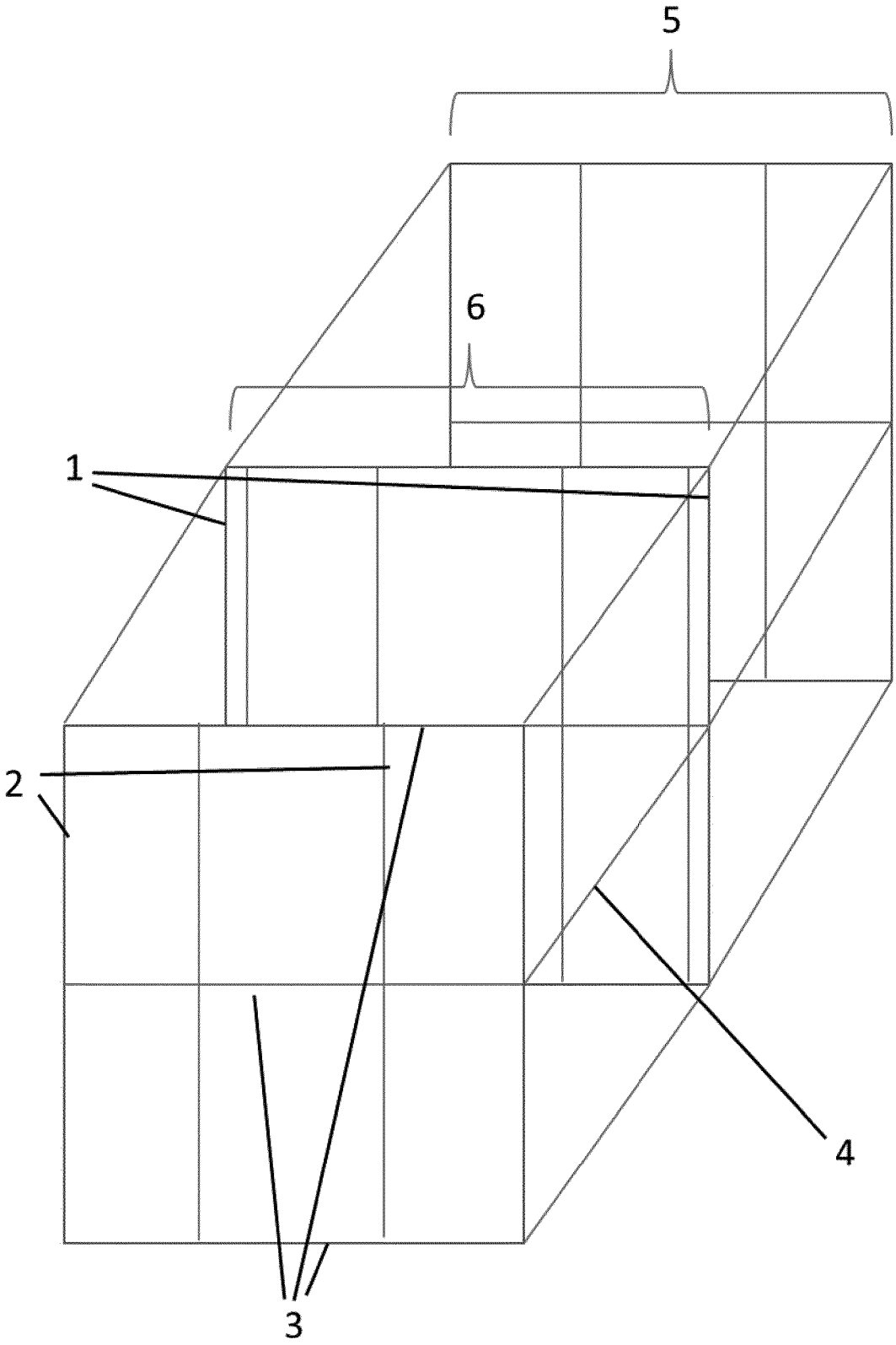
FIG. 4: A perspective view of a three dimensional framework
Figure 5:
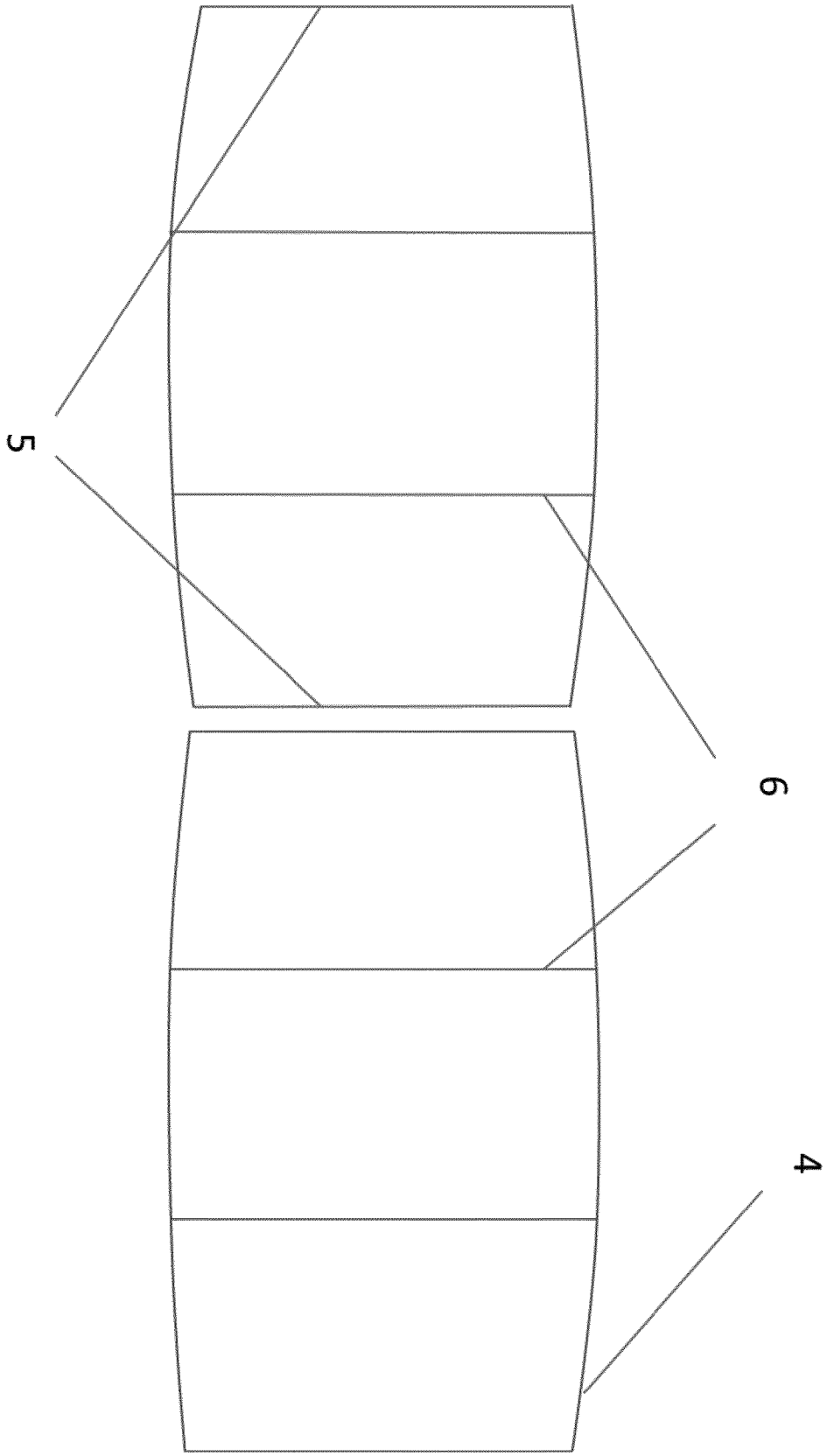
FIG. 5: A top view of two wall modules according to the present invention

According to a preferred embodiment of the present invention as seen in in FIGS. 4 and 5, the wall module comprises lattices of the second type 5 at least one and preferably both end standing positions, i.e. at the outer transversal edges of the wall module and a series of lattices of the first type 6 in between the two end standing positions. As such two zones are defined along the wall module wherein the grid for accommodating stucco or plaster only comprises the brace wires 4, in which zones the brace-wires are bent towards the wall module panels joining the outer most longitudinal wires of the lattice of the second type.

Figure 6:
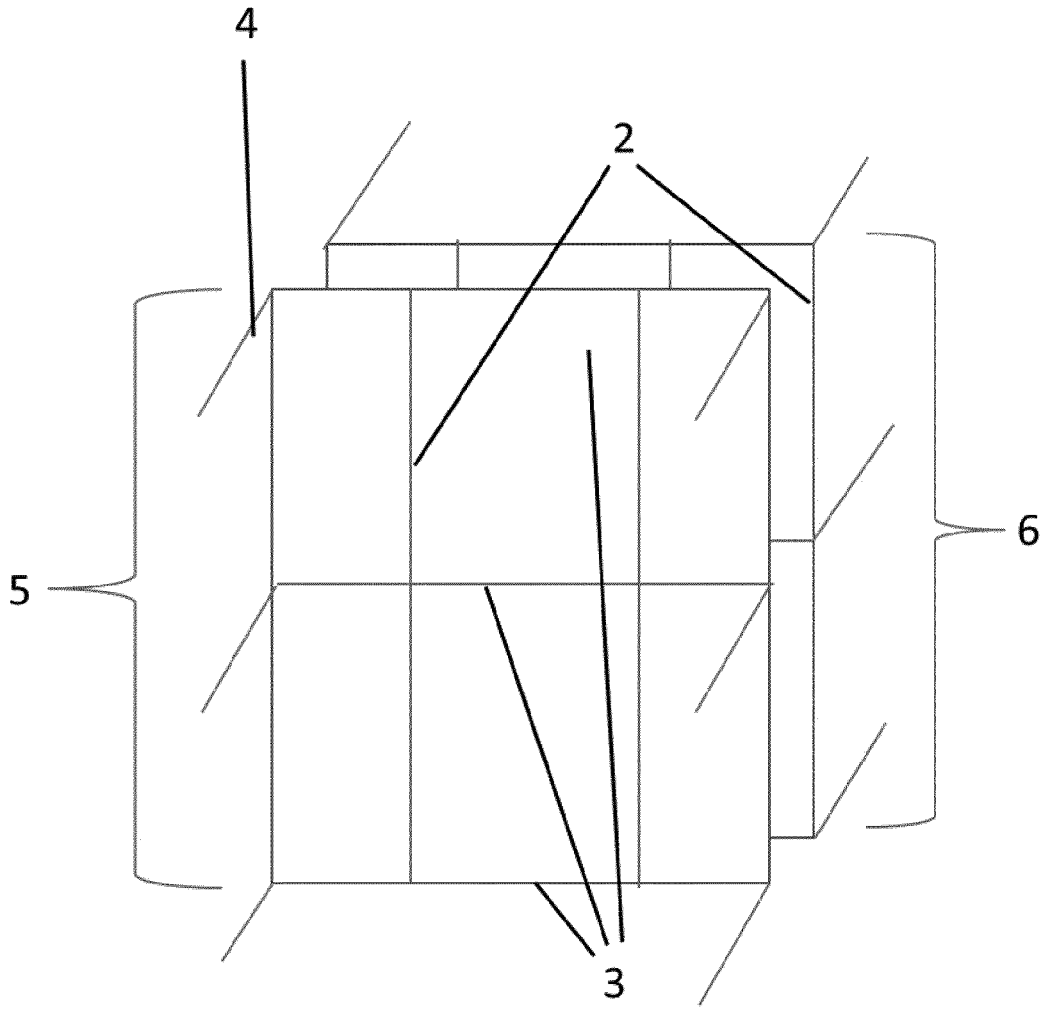
FIG. 6: A perspective view of the outer lattices of two wall modules

When erecting a wall or building with wall modules according to the present invention, adjacent wall modules in said wall are positioned to face each other as seen in FIG. 6 such that at the interface of both modules, at least on of end-standing lattices of both modules is a lattice of the second type 5-6. Once the prefabricated wall modules are positioned correctly, a load bearing material is poured in the cavity between both panels to form a load-bearing wall. Once dried, a covering material such as stucco, plaster, concrete or even façade panels can be applied on the grid of the wall modules for finishing.

Additionally an insulation wafer consisting of light-weight panels made from polystyrene, polyurethane or any other material that has insulating properties and/or has fire retarding properties can be applied on the grid. These insulation panels are provided with incisions that correspond with the grid of the wall module. By this the wafer can be easily attached to the wall by pushing the wafer against the wall module such that the grid is accommodated tightly into the incisions of the wafer, such that the wafer is retained on the grid without the need for any other mechanical or chemical connection means than the retention of the grid in the incisions.

When positioning the wall modules as described above, the grids defined along both wall modules have a lower wire density in the interface zone A than in case both wall modules would have comprised lattices of the first type in the end-standing positions. Surprisingly, using wall modules according to the present invention allows improving stucco, plaster and concrete finishing quality in the interface zone A, than walls comprising only lattices of the first type.

The invention claimed is:

1. A prefabricated wall module comprising a series or plurality of lattices connected to one another by brace wires extending perpendicular to the lattices, said series of lattices comprising at least two types of lattices, a first type of lattice comprising a number of longitudinal slot wires; a number of longitudinal grid wires and a number of transversal wires connecting the longitudinal slot wires and grid wires of the concerned lattice; and a second type of lattice comprising a number of longitudinal slot wires and a number of transversal wires connecting the longitudinal slot wires of the concerned lattice, said second type of lattice lacking grid wires;

the slot wires of both the first and second type of lattices together defining at least one slot accommodating a panel; and the grid wires of the first type of lattice defining at least one grid along an outer surface of said wall module;

wherein at least one end-standing lattice of said wall module is of the second type;

said brace wires extending substantially parallel to said outer surface of the wall are bent towards the panel in proximity of at least one edge of said wall module.

2. The prefabricated wall module according to claim 1, both end-standing lattices of said wall module are of the second type.

3. The prefabricated wall module according to claim 1, wherein said end-standing lattice of said wall module does not form part of said grid.

4. The prefabricated wall module according to claim 3 wherein a coating is applied on at least part of said grid in proximity of the wall module edges.

5. The prefabricated wall module according to claim 2, wherein a coating is applied on at least part of said grid in proximity of the wall module edges.

6. A wall comprising at least two prefabricated wall modules, one of which is a wall module as identified in claim 1.

* * * * *